United States Patent [19]

Goff, Jr. et al.

[11] 4,015,641

[45] Apr. 5, 1977

[54] CUSHIONED NARROW WOVEN TUBULAR FABRIC

[75] Inventors: Richard Everett Goff, Jr., Barrington; Normand Daniel Guay, Woonsocket; Joseph Amos Priestley, Barrington, all of R.I.

[73] Assignee: Johnson & Johnson, New Brunswick, N.J.

[22] Filed: July 16, 1975

[21] Appl. No.: 596,473

[52] U.S. Cl. ..... 139/384 R; 139/387 R; 139/410

[51] Int. Cl.[2] ..... D03D 3/02; D03D 11/02

[58] Field of Search ..... 139/387 R, 384 R, 397, 139/408–415, 420 R

[56] References Cited

UNITED STATES PATENTS

| | | | |
|---|---|---|---|
| 2,250,261 | 7/1941 | Goldsmith | 139/387 R |
| 2,356,456 | 8/1944 | Garner | 139/397 X |
| 2,502,101 | 3/1950 | Morgan et al. | 139/384 R |
| 3,232,319 | 2/1966 | Marco | 139/410 X |
| 3,463,202 | 8/1969 | Wildi et al. | 139/408 |
| 3,537,488 | 11/1970 | Lebonenf | 139/415 |
| 3,606,914 | 9/1971 | Maiwald et al. | 139/420 R |

FOREIGN PATENTS OR APPLICATIONS

| | | | |
|---|---|---|---|
| 319,847 | 8/1902 | France | 139/384 R |

*Primary Examiner*—James Kee Chi

[57] ABSTRACT

A narrow woven tubular fabric having an upper layer and a lower layer resiliently separated by a plurality of monofilament warp yarns alternately and intermittently woven with said layers.

8 Claims, 8 Drawing Figures

CUSHIONED NARROW WOVEN TUBULAR FABRIC

A narrow woven tubular fabric with two layers resiliently separated from one another to provide a cushion or sponge effect.

Tubular woven fabrics have been known for a considerable time. In some instances, tubular woven fabrics have been woven using thermoplastic yarns intermittently woven in the various layers. The fabric is heated to shrink the thermoplastic yarns and give the fabric a three-dimensional or puffed effect. In other instances, tubular fabrics are woven and the space between layers packed with foam material, or similar material to provide a cushion effect. In still other instances, the tubular fabrics may be woven with light, fluffy yarns, such as the synthetic texturized yarns, woven between the layers to provide the tubular fabric with a certain amount of puffiness.

What we have discovered is that if a tubular fabric is woven using monofilament filling yarns in both layers of the fabric and these monofilament filling yarns are alternately and intermittently woven with monofilament warp yarns to connect the two layers together, the resultant fabric will have a flattened oval cross-sectional appearance and will unexpectedly have excellent cushion properties and resiliency between the two layers. The resultant product will be stable up to widths of about three inches after which the layers have to be further tied down by other yarns in order to make the fabric stable.

The resultant product has a wide variety of uses and may be used wherever cushion or sponge characteristics are desired, for example, as in the shoulder straps of brassieres, straps on knapsacks or back-packing equipment, straps on scubadiving equipment and the like, as bumper guards on docks for boats or similar bumper guard applications. If elastic warp yarns are incorporated in the fabric, they may give the fabric a stretch characteristic in the warpwise direction which provide a myriad of other possible uses for such a product.

In the preferred embodiments of the present invention, the monofilament filling yarns used in both layers of the tubular woven fabric should have a denier of between 100 and 2,080 and preferably between 330 and 1,100. These size monofilament filling yarns are combined with monofilament warp yarns having a denier of from 100 to 2,080 and preferably with warp yarns having a denier of from 330 to 1,100. It, of course, is important that the deniers of the yarns in the warp and filling direction be reasonably balanced to provide suitable products. Along with the monofilament warp yarns used to connect the two layers together, other warp yarns may be used in each of the layers. These other yarns may be of virtually any type depending upon the properties desired in the final product. The yarns may be monofilament yarns, multifilament yarns, elastic yarns, non-elastic yarns, texturized yarns, spun yarns and the like. The type of yarn is chosen depending on the desired softness, abrasion resistance or other properties required in the final product.

The invention will be more fully described in conjunction with the accompanying drawings wherein:

FIG. 3 is an expanded sectional view running longitudinally or in the warp direction of the fabric showing the specific weave used in the tubular fabrics of the present invention;

FIG. 3*a* is a sectional view taken at *a*—*a* of FIG. 3;

FIG. 3*b* is a similar sectional view taken at *b*—*b* of FIG. 3;

FIG. 3*c* is a similar sectional view taken at *c*—*c* of FIG. 3;

FIG. 3*d* is a similar sectional view taken at *d*—*d* of FIG. 3; and

Figure 4:
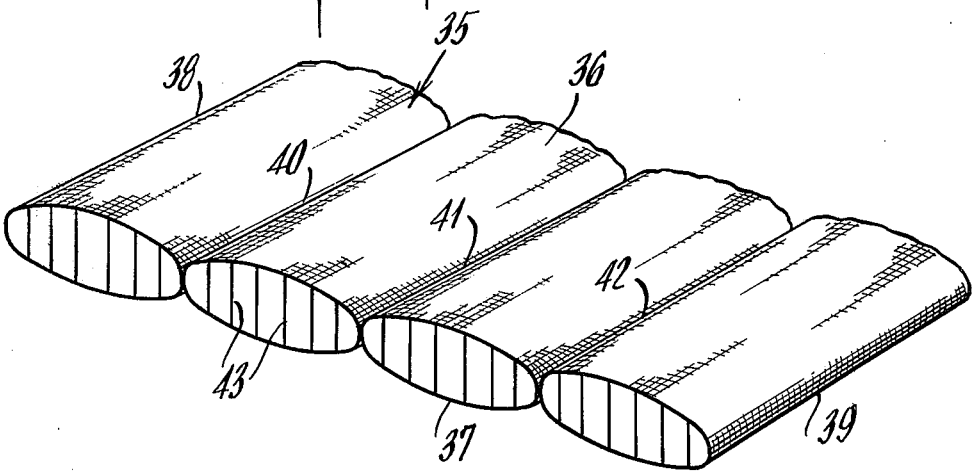
Figures 5, 5A, 5B, 5C, 5D:
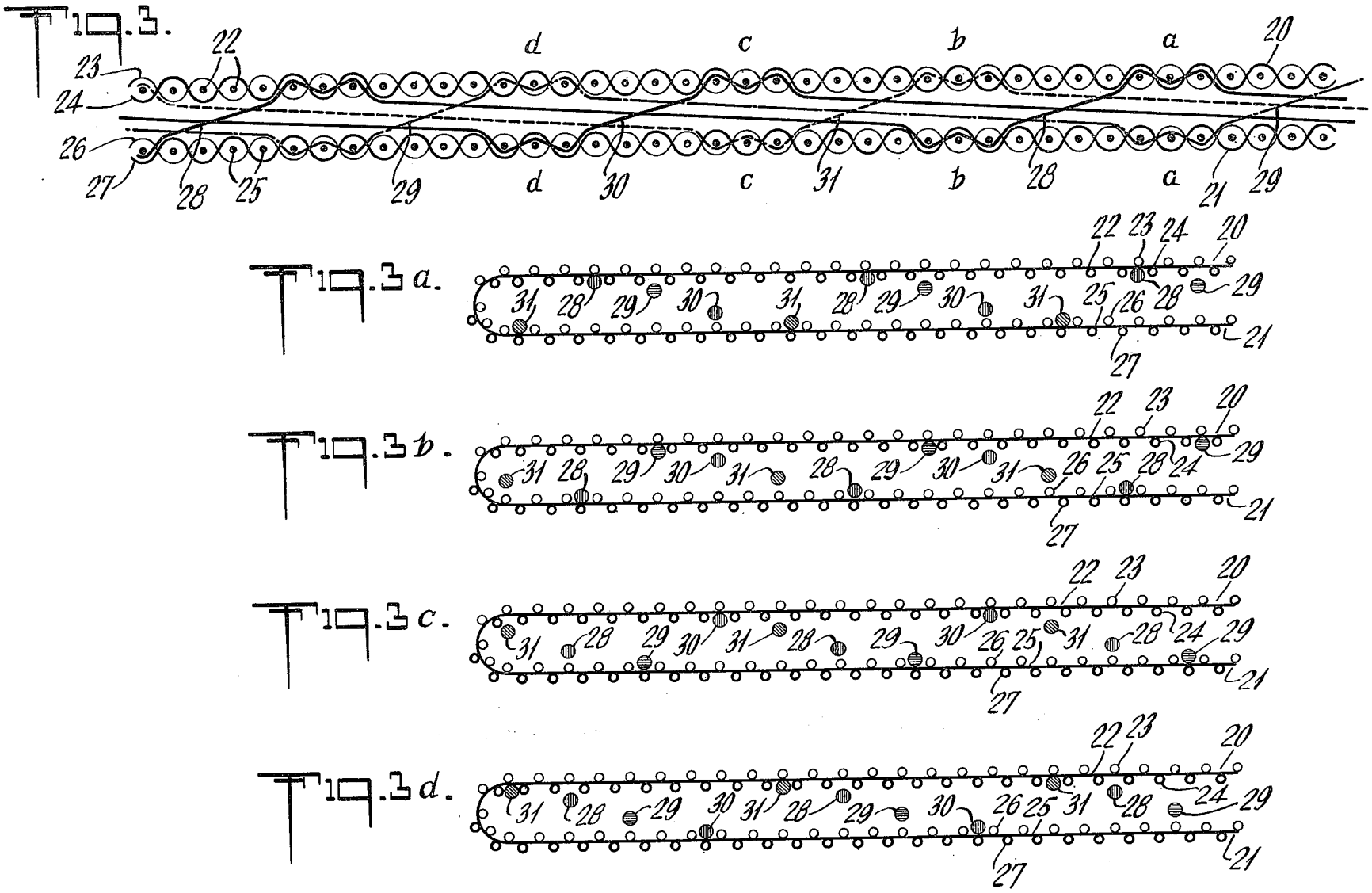

FIG. 4 is a perspective view of another embodiment of the tubular woven fabric of the present invention.

Figure 1:
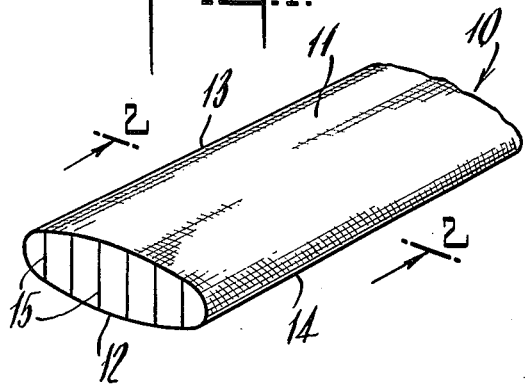
FIG. 1 is a perspective view of the new tubular woven fabric of the present invention.
Figure 2:
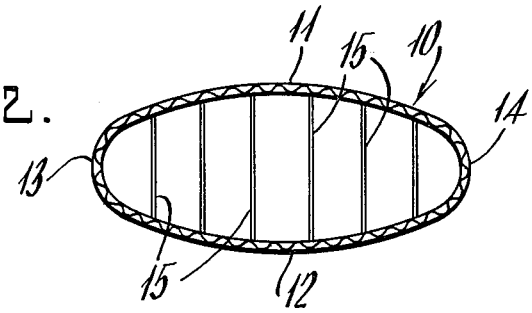
FIG. 2 is a cross-sectional view taken along line 2—2 of FIG. 1.

Referring to the drawings, in FIGS. 1 and 2, there is shown a narrow woven tubular fabric 10 according to the present invention. The fabric comprises an upper layer 11 and a lower layer 12 woven in a tubular weave so that the layers are connected or attached along their longitudinal edges 13 and 14.

The filling yarns used to produce the fabric of the present invention are monofilament filling yarns. The filling yarns may be polyester monofilament yarns, polyamide monofilament yarns, rayon monofilament yarns, polyolefin monofilament yarns and the like. The monofilament filling yarns have a denier ranging from 100 to 2,080 and preferably from 330 denier to 1,100 denier. The monofilament filling yarns are woven in both the upper layer and the lower layer with any type of warp yarn. The warp yarns used may be monofilament yarns, multifilament yarns, spun yarns as desired and these warp yarns may be made from artificial, natural or synthetic fibers. The warp yarns may be elastic or non-elastic yarns, or various combinations may be used. The type of warp yarns weaving the upper and lower layers and the number of yarns and type of weave used may be varied over wide ranges and will be primarily controlled by the desired end use for the fabric; i.e., properties desired such as abrasion resistance, elasticity, hand and the like and, of course, by economics.

The critical factor in the warp yarns is in those warp yarns used to weave or tie the upper layer and lower layer together. These yarns are monofilament warp yarns which connect the upper and lower layer together throughout the body of the fabric to produce a resiliently compressible tubular fabric. These monofilament warp yarns may be either polyester monofilament yarns, polyamide monofilament yarns, polyolefin monofilament yarns or rayon monofilament yarns. The monofilament warp yarns have a denier of from 100 to 2,080 and preferably between 330 denier and 1,100 denier.

To provide the desired resiliency in the fabrics of the present invention, every fourth filling yarn in each layer should be tied down by a monofilament warp yarn which is extending from one layer to the opposite layer and the monofilament warp yarns should be spaced across the fabric about every four yarns. If greater resiliency is desired, the monofilament filling yarns can be tied down every third yarn or if less resiliency is desired, then every fifth or sixth yarn. The spacing between the tieing down warp yarns, across the width of the fabric, may also be varied to change the resiliency characteristics.

In many instances, especially when using the higher denier monofilament warp yarns, a warp yarn will be woven with two, three or four adjacent filling picks in order to reduce the tendency of the monofilament yarn to form sharp points or abrasive edges on the surface of the fabric.

The monofilament warp and filling yarns should be balanced in that the total denier of monofilament warp and filling yarns should be at least 300 and no greater than 4,200. Preferably, the total denier of the monofilament warp yarns and monofilament filling yarns should be at least 430 denier. The size of monofilament warp yarns to monofilament filling yarns should be in the range of from 20:1 to 1:20 and preferably from 7:1 to 1:7 in order to produce well-balanced resilient products.

By keeping the total denier of the monofilament yarns and the balance of the monofilament filling and warp yarns within the ranges described above, the resulting fabric will have a flattened, oval cross-section as is more clearly seen in FIG. 2. The fabric 10 will comprise an upper layer 11 and a lower layer 12 with the two layers attached or woven together along their respective longitudinal edges 13 and 14. Uniformly throughout the length and width of the fabric, the upper and lower layers will be connected to each other by the monofilament warp yarns 15 as described above.

In FIG. 3, there is shown an expanded view depicting a specific weave used to produce fabrics in accordance with the present invention. This figure is a cross-sectional view taken along the length or warp direction of the fabric. The fabric comprises an upper layer 20 and a lower layer 21. The upper layer comprises monofilament filling yarns 22. Woven with these monofilament filling yarns are warp yarns 23 and 24 which may be spum yarns or multifilament yarns as desired. These warp yarns are woven in this embodiment in a plain one-over-one weave. The lower layer of the fabric also comprises monofilament filling yarns 25 woven with similar warp yarns 26 and 27 in a plain one-by-one weave. The upper and lower layers are alternately and intermittently connected together by monofilament warp yarns 28, 29, 30 and 31. The first monofilament warp yarn 28 extends from the lower layer to the upper layer floating between four filling yarns in both the upper layer and the lower layer. This monofilament warp yarn is then woven with the three filling yarns and floats back to the lower layer extending between 18 filling yarns in each of the upper and lower layers. This monofilament warp yarn is then woven with three adjacent filling yarns in the lower layer and floats back up to the upper layer extending between the four adjacent filling yarns in each of the layers and this weave then repeated. Each monofilament warp yarn 29, 30 and 31 connects the upper and lower layers in a similar manner but is spaced from adjacent warp yarns in both the longitudinal direction of the fabric as well as across the transverse direction of the fabric. In the longitudinal direction of the fabric, as may be seen in the upper layer of FIG. 3, a monofilament warp yarn 28 is woven with three adjacent filling yarns 22 and then floated to the bottom layer. There are then four filling yarns 22 which are not tied down and then the next three adjacent filling yarns 22 are again tied down by another monofilament warp yarn 29 and so on along the length of the fabric. As may be more clearly shown in FIGS. 3*a, b, c* and *d*, the monofilament warp yarns 28, 29, 30 and 31 connecting the upper and lower layer are spaced across the width of the fabric uniformly. There are approximately four warp yarns 23 and 24 woven with the upper layer between adjacent monofilament warp yarns 28 and 29 which connect the two layers. Concurrently there are four warp yarns 26 and 27 woven with the bottom layer between adjacent monofilament warp yarns 28 and 29 connecting the two layers.

The first monofilament warp yarn 28 is woven with the upper layer at point *a* and is woven with the bottom layer at point *b* and then is floated back up to the upper layer at points *c* and *d*. Its immediately adjacent monofilament filling yarn 29 is being floated to the top layer at point *a*, is woven with the top layer at point *b*, woven with the bottom layer at point *c* and being floated up to the top layer again at point *d*. Its immediately adjacent monofilament warp yarn 30 is being floated to the top layer at points *a* and *b*, is woven with the top layer at point *c* and woven with the bottom layer at point *d* and its immediately adjacent monofilament warp yarn 31 is woven with the bottom layer at point *a*, floated to the top layer at points *b* and *c* and woven with the top layer at point *d*. This alternately connecting weave is then repeated across the width of the fabric.

The Figures show every fourth warp yarn to be a tieing yarn between two layers. This may be varied so that every third yarn or fifth yarn or sixth yarn is a tieing yarn between the two layers. Though in the Figures it is shown that there are only four adjacent filling yarns which are not directly tied between layers, this may also be varied and every third or every fifth filling yarn may be tied as desired depending on the amount of resiliency desired in the final product.

To produce stable fabrics in accordance with the present invention, the width of the fabric should be three inches or less. If the two layers are woven more than three inches wide, there is considerable transverse movement with respect to the two layers. In FIG. 4, there is shown an embodiment of the present invention which will overcome this instability in the fabric. Along the transverse direction of the fabric 35, the upper layer 36 and the lower layer 37 are woven together as one layer every so often, preferably less than three inches. In this embodiment, the fabric 35 comprises an upper layer 36 and a lower layer 37 which are connected together along their longitudinal edges 38 and 39, and which are woven together at spaced intervals 40, 41 and 42 across the width of the fabric. In between these connected spaced intervals, the fabric is woven as described in conjunction with FIG. 1 wherein monofilament warp yarns 43 extend between the two layers alternatively and intermittently connecting the two layers to produce resiliency.

A specific mode of practicing the present invention is given by the following example:

EXAMPLE

The fabric is woven on a narrow fabric automatic loom using 104 ends per inch and 120 picks per inch. The fabric is woven in a tubular weave with 60 picks to each layer. The filling yarns used are 330 denier monofilament nylon yarns. The warp yarns used comprise 96 polyester spun yarns. Thirty-eight of these polyester spun yarns are woven in the top layer and 38 are woven in the bottom layer. The polyester spun yarns are woven in a plain one-over-one weave in both the top layer and the bottom layer. Approximately ten of these polyester warp yarns are woven along the longitudinal edges of the fabric with the filling yarns changing from the bottom to the top layer of the fabric and vice versa.

The total width of the fabric is approximately ⅝ inch. Evenly spaced among these warp yarns are eight 330 denier monofilament nylon warp yarns. Approximately nine polyester spun warp yarns are woven along one longitudinal edge of the upper layer and then the monofilament warp yarn, followed by four polyester spun warp yarns, followed by another monofilament warp yarn and so forth across the width of the fabric, until you reach the other edge of the fabric, when again, nine polyester spun warp yarns are woven. The bottom layer of the fabric is woven in a similar manner. The first monofilament warp yarn floats in the center of the web for eight picks and then weaves one and one on the ninth pick. It then floats 28 picks and weaves the bottom layer for one pick. Each immediately adjacent monofilament warp yarn is woven in a similar manner but is spaced four warp yarns away and four filling yarns away so that the two layers are uniformly completely tied together throughout the fabric. The resultant fabric has excellent resiliency and makes a very suitable sponge shoulder strap for a brassiere.

It will be apparent that while we have disclosed preferred embodiments of our invention and have indicated changes, additions and embodiments which will be made thereon numerous other embodiments of our invention as well as other changes and additions may be made without departing from the scope and spirit of the invention.

What is claimed is:

1. A narrow woven tubular fabric having a flattened oval cross-section, said fabric comprising an upper layer and a lower layer, both of said layers containing monofilament filling yarns, said monofilament filling yarns having a denier between 100 to 2080, said layers being connected together along their longitudinal edges and said layers being resiliently separated by a plurality of monofilament warp yarns alternately intermittently woven with each of said layers, said monofilament warp yarns having a denier of between 100 to 2080, the sum of the denier of a monofilament filling yarn plus a monofilament warp yarn being in the range of from 430 denier to 4200 denier and the ratio of denier of monofilament filling yarn to monofilament warp yarn being from 20:1 to 1:20.

2. A narrow woven tubular fabric according to claim 1 having a width of three inches or less.

3. A narrow woven tubular fabric according to claim 1 wherein the ratio of denier of monofilament filling yarn to monofilament warp yarn is 7:1 to 1:7.

4. A narrow woven tubular fabric according to claim 1 wherein both the upper layer and the lower layer include a plurality of warp yarns woven with the filling yarns in a plain one-by-one weave in each layer.

5. A narrow woven tubular fabric according to claim 1 wherein the upper and lower layers include elastic warp yarns woven with the filling yarns in both layers to produce a narrow fabric having elasticity in its longitudinal direction.

6. A narrow woven tubular fabric according to claim 1 wherein there are four filling yarns between each filling yarn woven with a monofilament warp yarn.

7. A narrow woven tubular fabric according to claim 1 wherein there are four warp yarns between adjacent monofilament warp yarns alternately and intermittently woven with each of said layers.

8. A narrow woven tubular fabric according to claim 1 wherein there are four filling yarns between yarns woven with the monofilament warp yarns and there are four warp yarns between adjacent monofilament warp yarns.

* * * * *